US006875075B2

(12) United States Patent
Rossi et al.

(10) Patent No.: US 6,875,075 B2
(45) Date of Patent: Apr. 5, 2005

(54) CLOSURE SYSTEM FOR A BRASSIERE

(75) Inventors: Cal Rossi, Huntersville, NC (US); Gloria Falla, Demarest, NJ (US)

(73) Assignee: Playtex Apparel, Inc, Stamford, CT (US)

( * ) Notice: Subject to any disclaimer, the term of this patent is extended or adjusted under 35 U.S.C. 154(b) by 61 days.

(21) Appl. No.: 10/218,695

(22) Filed: Aug. 14, 2002

(65) Prior Publication Data

US 2003/0060123 A1 Mar. 27, 2003

Related U.S. Application Data

(60) Provisional application No. 60/312,108, filed on Aug. 14, 2001.

(51) Int. Cl.[7] ..... A41C 3/00

(52) U.S. Cl. ..... 450/13; 24/697.1; 24/697.2

(58) Field of Search ..... 450/13, 14, 17, 450/18, 25, 26, 28, 34, 35, 72, 73, 80, 82, 1; 2/96, 141.1, 141.2, 219, 235, 321, 322, 257, 265, 263, 264, 336, 338; 24/697.1, 697.2, 592.1, DIG. 43, DIG. 49

(56) References Cited

U.S. PATENT DOCUMENTS 1,421,062 A * 6/1922 Brenner ..... 2/251
2,370,754 A * 3/1945 Roseman ..... 24/DIG. 43
2,681,452 A * 6/1954 Rabinowitz ..... 24/697.1
2,802,215 A * 8/1957 Alfandre ..... 2/263
3,066,310 A * 12/1962 Roseman ..... 2/DIG. 43
3,528,140 A * 9/1970 Waldes ..... 24/DIG. 43
3,530,813 A * 9/1970 Roseman ..... 2/263
4,054,972 A 10/1977 Rowell
D250,299 S 11/1978 Rowell
6,200,194 B1 3/2001 Grier
6,321,419 B1 11/2001 Fildan et al.
6,347,438 B1 2/2002 Fildan et al.
6,431,947 B1 8/2002 Henz
6,520,832 B2 * 2/2003 Devita et al. ..... 450/1

* cited by examiner

*Primary Examiner*—Gloria M. Hale
(74) *Attorney, Agent, or Firm*—Ohlandt, Greeley, Ruggiero & Perle L.L.P.

(57) ABSTRACT

A hook and eye fastener is provided in which either, or both of, the hook fastener fabric tape or the eye fastener fabric tape is made of a stretchable material. Preferably, the fabric tape can stretch primarily in a horizontal direction. The fabric tape may be single or multi-ply. In an alternative embodiment, the eye fastener fabric tape is a one piece, open knit construction. This open knit construction provides a number of eyes for a variety of adjustment possibilities with the corresponding hooks.

26 Claims, 4 Drawing Sheets

CLOSURE SYSTEM FOR A BRASSIERE

This application claims the benefit of Provisional application No. 60/312,108 filed Aug. 14, 2001.

BACKGROUND OF THE INVENTION

1. Field of the Invention

The present invention relates generally to a closure system for a garment. Particularly, the present invention relates to a hook and eye fastener. More particularly, the present invention relates to a hook and eye fastener for a brassiere. Still more particularly, the present invention relates to a hook and eye fastener for a brassiere that has the ability to stretch.

2. Description of the Prior Art

Garment fasteners for securing the back panels of a garment, for example, a brassiere, may have various configurations to facilitate connection of a pair of back panels and separation thereof. In addition, such fasteners must be capable of withstanding substantial tension thereon. It is advantageous that the fastener be flexible for comfort. Aesthetic considerations are also significant factors.

The most typical fasteners for this purpose are hook and eye fasteners. With such fasteners, a number of eyes are usually provided on one end of a back or front panel and are engaged by a number of hooks on one end of a corresponding second back or front panel. The hooks and eyes are usually made of wire. While this type of fastener is widely used, it has certain disadvantages. First, the hooks and eyes themselves are not flexible. Second, the hooks may damage the garment by catching and tearing it. Third, the fastener may not be comfortable for the wearer. Fourth, laundering of the hooks and eyes often poses a problem because the wire may eventually rust after repeated washings. Fifth, such fasteners only have a limited number of adjustment combinations.

The present invention is directed to hook and eye fasteners for use in a brassiere in which the fabric tape of one or both of the hook fasteners and eye fasteners are stretchable. Preferably, the number of hooks and eyes is the same. More preferably, the number of eyes is greater than the number of hooks in order to provide a greater number of adjustment possibilities. The hooks in a vertical row should align with the eyes in a corresponding row in order facilitate closure of the fastener.

SUMMARY OF THE INVENTION

It is an object of the present invention to provide a hook and eye fastener that has the ability to stretch.

It is another object of the present invention to provide a hook and eye fastener in which each row of hook fasteners and/or eye fasteners has the ability to stretch separate and apart in relation to the other hook fasteners and/or eye fasteners on the same fabric tape.

It is yet another object of the present invention to provide a hook and eye fastener that is capable of multiple adjustments in order to accommodate a variety of a brassiere sizes.

These and other objects of the present invention are achieved by a hook and eye fastener in which either, or both of, the hook fastener fabric tape or the eye fastener fabric tape is made of a stretchable material. Preferably, the fabric tape is adapted to stretch primarily in a horizontal direction. The fabric tape may be single or multi-ply. In an alternative embodiment, the eye fastener fabric tape is a one piece, open knit construction. This open knit construction provides a number of eyes for a variety of adjustment possibilities with the corresponding hooks.

DETAILED DESCRIPTION OF THE INVENTION

Figure 1:
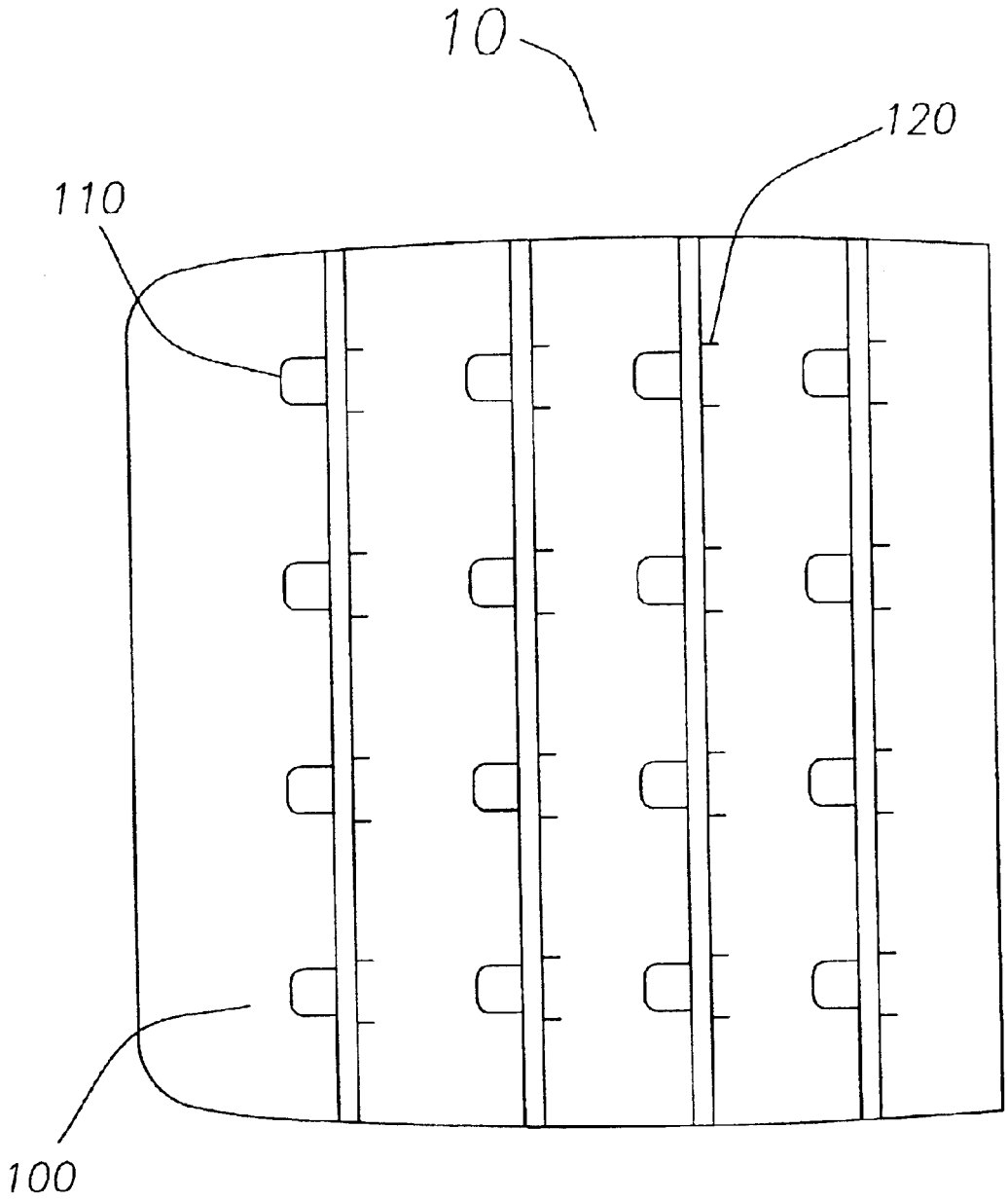
FIG. 1 is a front view of the eye fastener fabric tape of the present invention.
Figure 2:
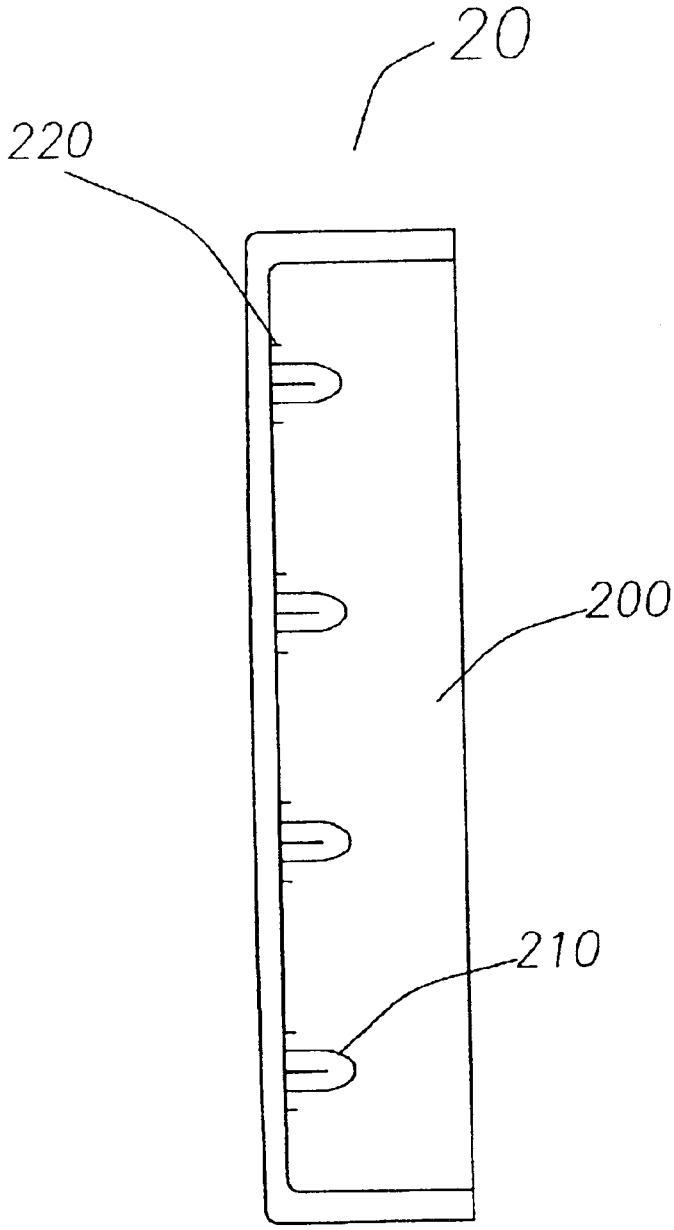
FIG. 2 is a front view of the hook fastener fabric tape of the present invention.

Referring to the drawings, and in particular, FIGS. 1 and 2, there is provided a hook and eye fastener. Referring to FIG. 1, a eye fastener fabric tape, generally represented by reference numeral 10, is shown. Eye fastener fabric tape 10 has a first fabric portion 100 and a fastener receptacle or eye 110 positioned on first fabric portion 100. Preferably, fastener receptacles 110 are adjacently positioned on first fabric portion 100 in one or more vertical rows, each row having at least one fastener receptacle.

Referring to FIG. 2, a hook fastener fabric tape 20, is shown. Hook fastener fabric tape 20 has a second fabric portion 200 and a hook fastener 210 positioned on second fabric portion 200. Preferably, the hook fasteners are adjacently positioned on second fabric portion 200 in one or more vertical rows, each row having at least one hook fastener. Fastener receptacle 110 is adapted to mate with a hook fastener 210.

As used herein the "vertical," is defined in reference to the orientation of the fastener as it would be positioned on a wearer's body, and thus as shown in FIGS. 1 and 2. Thus, fastener receptacles 110 are positioned vertically, i.e. in the same direction as the spine of the wearer.

As shown in FIGS. 1 and 2, both eye fastener fabric tape 10 and hook fastener fabric tape 20 are preferably square or rectangular in shape. Preferably, the corners of fabric tapes 10, 20 are rounded. However, eye fastener fabric tape 10 and hook fastener fabric tape 20 may be any shape or configuration that maintains closure of brassiere during all movements of the wearer.

According to the present invention, either or both first fabric portion 100 and second fabric portion 200 are made partially or fully of a stretchable material that is adapted to stretch primarily, and preferably only, in the sideways or horizontal direction, i.e. across the wearer's back. Thus, first fabric portion 100 and second fabric portion 200 provide primarily one way stretch, namely first fabric portion 100 and second fabric portion 200 are substantially non-stretchable in the vertical direction, that is perpendicular to the horizontal direction, and substantially, preferably completely, stretchable in the horizontal direction.

Preferably, first fabric portion 100 and second fabric portion 200 are made of a stretchable, elastomeric material. The material may be either single ply or multi-ply. The type of material may be either a warp knit, a woven knit, a mesh knit, a circular knit, an elastomer, or elastic.

In a first embodiment of the present invention, both first fabric portion 100 and second fabric portion 200 are made of a stretchable material. The amount of stretch in first fabric portion 100 and second fabric portion 200 ranges from about 15% to about 100% more than a standard, non-stretchable fastener tape. Preferably, the amount of stretch in first fabric portion 100 and second fabric portion 200 ranges from about 20% to about 30% more than a standard, non-stretchable fastener tape. In this first embodiment, it is preferable that first fabric portion 100 be more stretchable than second fabric portion 200. More preferably, first fabric portion 100 is approximately 50% more stretchable than second fabric portion 200.

In a second embodiment of the present invention, either first fabric portion 100 or second fabric portion 200 is made of a stretchable material, while the other corresponding fabric portion is virtually, or entirely, non-stretchable. In this second embodiment, first fabric portion 100 is preferably made of the stretchable material.

Basically, whether second fabric portion 200 is non-stretchable or stretchable, first fabric portion 100 stretches about 15% to about 100% more than a standard, non-stretchable fastener tape. Preferably, the amount of stretch in first fabric portion 100 ranges from about 20% to about 30% more than a standard, non-stretchable fastener tape. The engagement of fastener receptacle 110 and hook fastener 210 results in a closure system with a stretch capability ranging from about 15% to about 50% more than a standard, non-stretchable hook and eye fastener closure system.

In embodiments of the present invention, shown in FIGS. 1 and 2, fastener receptacle 110 is anchored to first fabric portion 100 by a first series of stitches 120. Hook fastener 210 is anchored to second fabric portion 200 by a second series of stitches 220. Stitches 120, 220 ensure that the area immediately surrounding fastener receptacle 110 and hook fastener 210 is non-stretchable in the vertical direction and substantially non-stretchable in the horizontal direction. Thus, while the remainders of first fabric portion 100 and second fabric portion 200 are stretchable, fastener receptacle 110 and hook fastener 210 are not stretchable.

In the present invention, fastener receptacle 110 and hook fastener 210 are traditional hook and eye fasteners. Fastener receptacle 110 and hook fastener 210 may be made of metal, plastic, or fabric. These metal, plastic or fabric fasteners may be encased in an elastomer in order to provide them with some measure of stretchability. It should be noted that fastener receptacle 110 and hook fastener 210 may be any closure system known in the art, including, but not limited to, snaps and/or hook-and-loop (e.g., "Velcro") systems.

In any embodiment of the present invention, stitches 120, 220 may be, but preferably are not, visible. Moreover in any embodiment, stitches 120, 220 must not have any harsh edges. Also in any embodiment, the edges of fabric tapes 10, 20 should not be sonically sealed, but instead should be sealed to an inside edge of the fabric tape. Preferably, fabric tapes 10, 20 are sealed one/thirty-second of an inch from the inside edge of the fabric tape.

In an alternative to any embodiment of the present invention, each vertical row of fastener receptacles 110 and each vertical row of hook fasteners 210 have the ability to stretch separate and apart from the other rows of fastener receptacles and/or hook fasteners positioned on the same fabric tape. The amount of stretch in each row of fastener receptacles 110 and hook fasteners 210 ranges from about 10% to about 15% more than a standard, non-stretchable fastener tape.

Another aspect of the present invention is that sections of eye fastener fabric tape 10, as well as the tape itself, may be manufactured to different sideways or horizontal lengths. Thus, there is provided an adjustability of sizes for large size garments for full figure women. In addition, eye fastener fabric tape 10 is made so as not to collapse, but instead to become narrower, when stretched.

Figure 3:
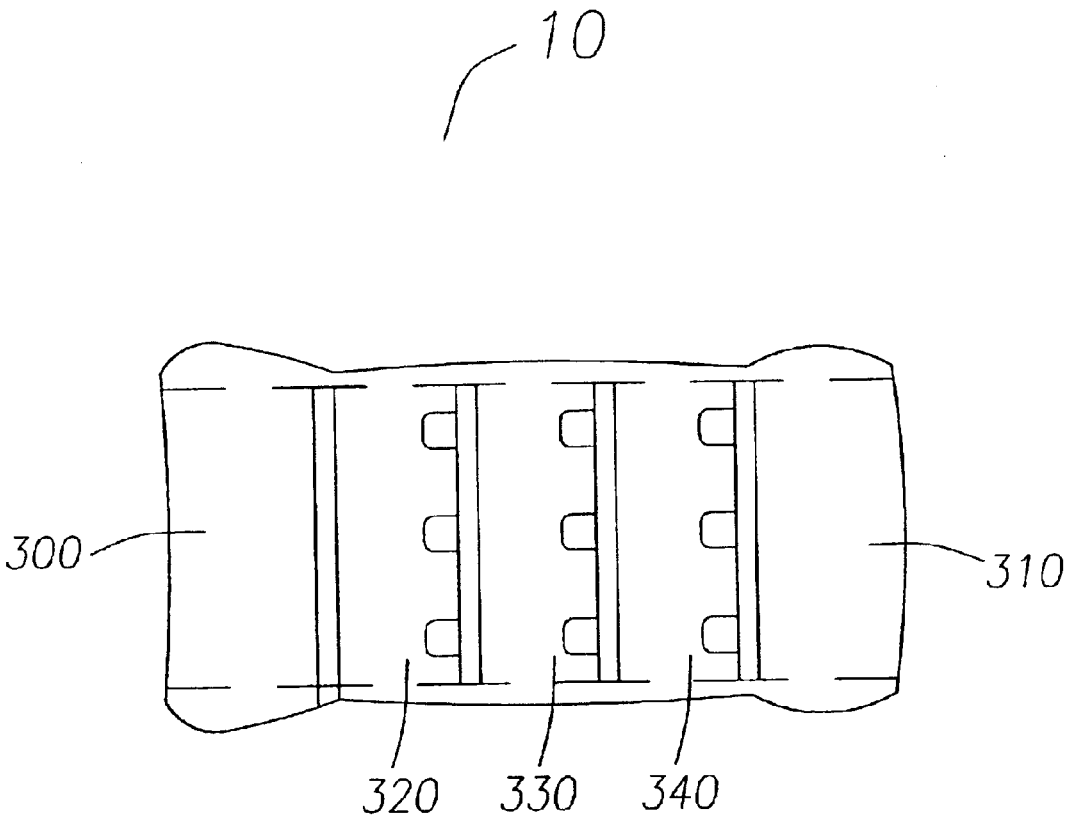
FIG. 3 is a first alternative embodiment of the eye fastener tape shown in FIG. 1.

In a first alternative embodiment of the present invention, shown in FIG. 3, eye fastener fabric tape 10 may have multiple sections. The sections may include a first end 300 and a second 310. The sections also have at least one middle section therebetween. In a preferred embodiment, the sections include a first middle section 320, a second middle section 330, and a third middle section 340 positioned between first end 300 and second end 310. First end 300 and second end 310 have an equal sideways or horizontal length and preferably have no stretch. The function of first end 300 and second end 310 is to provide a tongue and opening for sewing. Middle sections 320, 330, 340 are stretchable. The stretch of middle sections 320, 330, 340 is about 10% to about 15% more than a standard, non-stretchable fastener tape. Each middle section 320, 330, 340 preferably has one vertical row of fastener receptacles or eyes.

Figure 4:
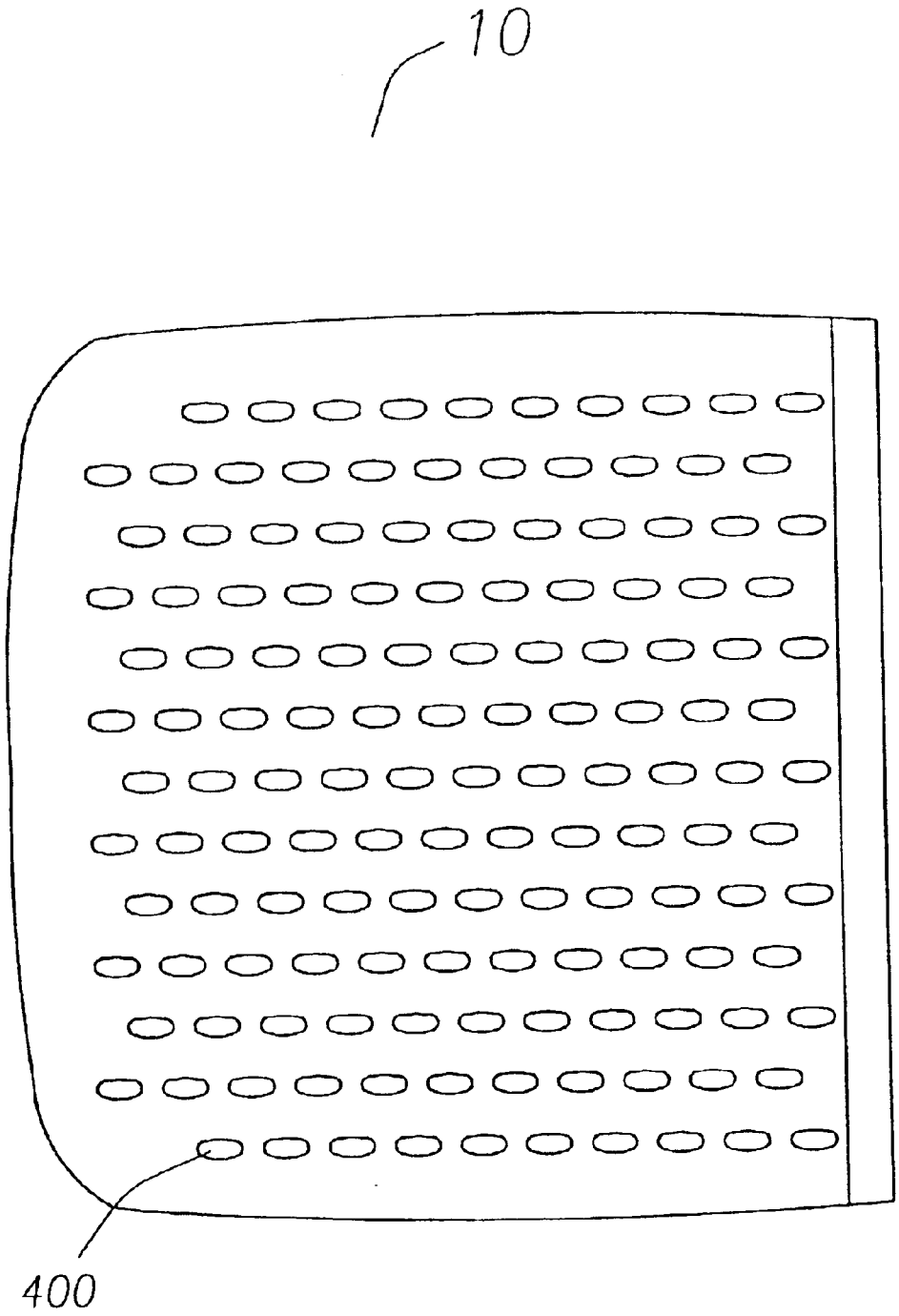
FIG. 4 is a second alternative embodiment of the eye fastener tape of the present invention utilizing an open knit construction.

In a second alternative embodiment, shown in FIG. 4, eye fastener fabric tape 10 is a one-piece construction. Eye fastener fabric tape 10 is an open knit material that is stretchable in the sideways or horizontal direction. The amount of stretch in the material ranges from about 15% to 100% more than a standard, non-stretchable fastener tape. Preferably, the amount of stretch in the material ranges from about 20% to about 30% more than a standard, non-stretchable fastener tape. The material used in eye fastener fabric tape 10 is a single or multi-ply mesh knit. Eye fastener fabric tape 10 is also rectangular in shape with rounded corners and soft, smooth edges. The open mesh knit construction provides a number of eyes 400 for engagement of a corresponding hook. The increased number of eyes that is inherent by this construction, provides for a large number of, and various, adjustment combinations with respect to corresponding hooks and, thus, the garment itself.

The present invention having been thus described with particular reference to the preferred forms thereof, it will be obvious that various changes and modifications may be made therein without departing from the spirit and scope of the present invention as defined in the appended claims.

What is claimed is:

1. A closure system for a brassiere comprising:

a first fastener tape having a first fabric portion and a plurality of fastener receivers; and a second fastener tape having a second fabric portion and a plurality of fasteners, said first and second fabric portions being made of a stretchable material wherein said first fabric portion is more stretchable than said second fabric portion, said plurality of fasteners being adapted to engage said plurality of fastener receivers.

2. The closure system of claim 1, wherein said stretchable material is substantially stretchable in a horizontal direction and substantially non-stretchable in a vertical direction.

3. The closure system of claim 1, wherein said stretchable material has one or more plies.

4. The closure system of claim 1, wherein said stretchable material is selected from the group consisting of warp knits, woven knits, mesh knits circular knits, elastics, elastomers, and any combinations thereof.

5. The closure system of claim 1, wherein said first fabric portion is approximately 50% more stretchable than said second fabric portion.

6. The closure system of claim 1, wherein said first and second fabric portions have a stretch capacity of about 15% to about 100% more than a non-stretchable material.

7. The closure system of claim 1, wherein said first fabric portion is stretchable, and wherein said second fabric portion is non-stretchable.

8. The closure system of claim 1, wherein the closure system has a stretch capacity ranging from about 15% to about 50% more than a non-stretchable material.

9. The closure system of claim 1, wherein said plurality of fastener receivers are anchored in said first fabric portion and said plurality of fasteners are anchored into said second fabric portion such that said plurality of fastener receivers and said plurality of fasteners are non-stretchable in the vertical direction and substantially non-stretchable in the horizontal direction.

10. The closure system of claim 1, wherein said plurality of fastener receivers and said plurality of fasteners are made of a material selected from the group consisting of metal, plastic, fabric, and any combinations thereof.

11. The closure system of claim 10, wherein said plurality of fastener receivers and said plurality of fasteners are encased in an elastomer.

12. The closure system of claim 1, wherein said plurality of fastener receivers are adjacently positioned on said first fabric portion in a plurality of vertical rows and said plurality of fasteners are positioned on said second fabric portion in a at least one vertical row such that said first and said second fabric portions allow each of said plurality of fastener receivers and/or each of said plurality of fasteners to move individually from other fastener receivers and/or fasteners positioned on said same fabric tape.

13. The closure system of claim 12, wherein said first fabric portion and said second fabric portion each have a stretch capacity of about 10% to about 15% more than a non-stretchable material.

14. A closure system for a brassiere comprising:

a first fastener tape having a first fabric portion and a plurality of fastener receivers, said first fabric portion having a first end a second end, and a plurality of fabric segments positioned between said first end and said second end, said first end and said second end being made of a non-stretchable material, said plurality of fabric segments being made of a stretchable material; and a second fastener tape having a second fabric portion and a plurality of fasteners, said plurality of fasteners being adapted to engage said plurality of fastener receivers.

15. The closure system of claim 14, wherein said stretchable material is selected from the group consisting of warp knits, woven knits, mesh knits, circular knits, elastomers, and any combinations thereof.

16. The closure system of claim 14, wherein said plurality of fabric segments have a stretch capacity of about 10% to about 15% more than non-stretchable material.

17. A closure system for a brassiere comprising:

a first fastener tape having a first fabric portion made of a stretchable mesh-knit material, said stretchable mesh-knit material having a plurality of fastener receivers therethrough, said stretchable mesh-knit material having one or more plies, said stretchable material being substantially stretchable in a horizontal direction and substantially non-stretchable in a vertical direction; and a second fastener tape having a second fabric portion and a plurality of fasteners, said plurality of fasteners being adapted to engage said plurality of fastener receivers, wherein said first fabric portion provides a plurality of fastener receivers for each of said plurality of fasteners.

18. The closure system of claim 17, wherein said fastener receivers are provided in a plurality of vertical rows in said mesh-knit material, and wherein said fasteners are capable of engaging said fastener receivers in said plurality of vertical rows when the brassiere is worn.

19. The closure system of claim 17, comprising at least three fasteners and at least four fastener receivers, wherein said at least three fasteners are capable of engaging any of said at least four fastener receivers when the brassiere is worn.

20. The closure system of claim 17, wherein said plurality of fastener receivers are arranged in a pattern.

21. The closure system of claim 19, wherein said at least four fastener receivers are in a plurality of rows.

22. The closure system of claim 21, wherein said at least four fasteners receivers are arranged in a diamond-shaped pattern.

23. A closure system for a brassiere comprising:

a first fastener tape having a first fabric portion made of a stretchable material, said stretchable material having at least four fastener receivers arranged in at least two vertical rows, said stretchable material having one or more plies, said stretchable material being substantially stretchable in a horizontal direction and substantially non-stretchable in a vertical direction; and a second fastener tape having a second fabric portion and at least three fasteners, wherein said at least three fasteners are adapted to engage any of said at least four fastener receivers in said at least two vertical rows when the brassiere is worn.

24. The closure system of claim 23, wherein said at least four fastener receivers are in a plurality of rows.

25. The closure system of claim 23, wherein said plurality of rows is at least three rows.

26. The closure system of claim 23, wherein said first fabric portion is a mesh-knit material, and wherein said at least four fastener receivers are formed therethrough.

* * * * *